US008860314B2

(12) United States Patent
Radermacher

(10) Patent No.: US 8,860,314 B2
(45) Date of Patent: Oct. 14, 2014

(54) LED LAMP

(75) Inventor: Harald Josef Guenther Radermacher, Aachen (DE)

(73) Assignee: Koninklijke Philips N.V., Eindhoven (NL)

( * ) Notice: Subject to any disclaimer, the term of this patent is extended or adjusted under 35 U.S.C. 154(b) by 181 days.

(21) Appl. No.: 13/391,557

(22) PCT Filed: Aug. 30, 2010

(86) PCT No.: PCT/IB2010/053875

§ 371 (c)(1),
(2), (4) Date: Feb. 21, 2012

(87) PCT Pub. No.: WO2011/027278

PCT Pub. Date: Mar. 10, 2011

(65) Prior Publication Data

US 2012/0146513 A1 Jun. 14, 2012

(30) Foreign Application Priority Data

Sep. 3, 2009 (EP) ..... 09169317

(51) Int. Cl.

| | |
|---|---|
| ***H05B 37/00*** | (2006.01) |
| ***F21K 99/00*** | (2010.01) |
| ***F21V 25/04*** | (2006.01) |
| *F21V 3/04* | (2006.01) |
| *F21Y 101/02* | (2006.01) |
| *F21V 3/02* | (2006.01) |

(52) U.S. Cl.

CPC ..... *F21V 25/04* (2013.01); *F21K 9/1355* (2013.01); *F21V 3/04* (2013.01); *F21Y 2101/02* (2013.01); *F21V 3/02* (2013.01); *F21V 3/0436* (2013.01); *F21K 9/1375* (2013.01)

USPC ..... 315/119; 315/51; 315/294

(58) Field of Classification Search

USPC ..... 315/51, 56, 119, 294, 306

See application file for complete search history.

(56) References Cited

U.S. PATENT DOCUMENTS

| | | | | |
|---|---|---|---|---|
| 4,375,607 | A * | 3/1983 | Morton et al. | 315/56 |
| 5,309,062 | A * | 5/1994 | Perkins et al. | 315/53 |
| 6,667,623 | B2 | 12/2003 | Bourgault et al. | |
| 2004/0202011 | A1 * | 10/2004 | Lee | 362/802 |
| 2005/0190553 | A1 | 9/2005 | Lynch et al. | |
| 2011/0050124 | A1 * | 3/2011 | Bailey et al. | 315/294 |

FOREIGN PATENT DOCUMENTS

| | | | |
|---|---|---|---|
| CA | 2126003 | A1 | 1/1995 |
| CN | 201123160 | Y | 9/2008 |
| DE | 4135596 | A1 | 5/1993 |
| EP | 1156271 | A1 | 11/2001 |
| FR | 2754667 | A1 | 10/1996 |
| JP | 2056698 | A | 2/1990 |
| JP | 2004253235 | A1 | 9/2004 |

* cited by examiner

*Primary Examiner* — Tung X Le
(74) *Attorney, Agent, or Firm* — Yuliya Mathis

(57) ABSTRACT

The invention relates to an LED lamp (1, 1', 1", 1''', 1'''') comprising at least one light emitting diode (LED, 2) arranged in a housing (3), and an isolation monitoring device (4) configured to determine a defect of the housing (3) and disconnect said at least one LED (2) from power in case said defect is detected, to enhance the safety of the LED lamp (1, 1', 1", 1''', 1'''') and reduce the risk of electric shock for a user.

10 Claims, 5 Drawing Sheets

LED LAMP

FIELD OF THE INVENTION

The invention relates to an LED lamp with a housing.

BACKGROUND OF THE INVENTION

LED lamps or in general LED lighting devices are known in the art and are commonly used today for a wide variety of lighting applications. In addition to being very compact in size, so-called high-power LEDs provide a high luminous flux and are very energy efficient.

Recently, LED lamps have been developed for retrofit applications, i.e. for replacing presently used incandescent or halogen lamps for home or office lighting. Since for such applications, it is necessary to allow a user to easily exchange the lamp, safety is an important aspect. Therefore, care has to be taken that the user does not get into contact with any live electrical parts, i.e. parts energized with an operating voltage, which could result in electric shock, especially when replacing the lamp.

It is therefore an object to provide an LED lamp, which can be safely handled without the risk of electric shock.

SUMMARY OF THE INVENTION

This object is achieved by means of an LED lamp, a lighting fixture and a corresponding method of operating an LED lamp as claimed and described herein.

The basic idea of the invention is to provide an LED lamp comprising at least one light emitting diode (LED) arranged in a housing and a device to determine whether the housing of the lamp is still intact and provides sufficient electrical isolation when in use. In case the electrical isolation is not provided, the at least one LED is shut-off, so that the risk of electric shock is reduced. Since the LED lamp according to the present invention thus provides electric shock protection itself, it is advantageously not necessary to modify the setup of the overall lighting fixture, which is extremely cost-efficient and furthermore allows retrofitting existing fixtures.

The LED lamp according to the invention comprises at least one light emitting diode (LED) arranged in a housing. In the context of the present invention, the term "LED" may refer to any type of solid state light source, such as inorganic LEDs, organic LEDs and solid state lasers, e.g. laser diodes.

The light emitting diode may be of any suitable type and color, depending on the application. For general lighting applications, the LED may preferably be a high-power LED, i.e. having a luminous flux of more than 1 μm. Preferably, said high-power LED provides a luminous flux of more than 20 μm, most preferably more than 50 μm. For retrofit applications, it is especially preferred that the total flux is in the range of 600-700 lm, which corresponds to a typical 60 W incandescent light bulb.

Certainly, the LED lamp may comprise more than one LED, for example in applications where color control of the emitted light is needed, such as RGB-LEDs, or to further increase the overall luminous flux of the LED lamp according to the application.

The housing may have any suitable geometry and dimensions for accommodating the at least one LED. The housing may be formed so as to be entirely closed or may be provided with one or more openings, e.g. for ventilation purposes, as long as the housing provides protection against accidental contact of a user with any live electrical parts in the operational state. Preferably, the housing has at least one opening, which allows at least a beam of light, generated by said at least one LED, to exit the housing.

The housing may be of any suitable material, such as metal, glass or plastics. Preferably, at least a section of the housing is transparent, e.g., formed from transparent plastic material or glass.

According to the invention, the LED lamp comprises an isolation monitoring device. The isolation monitoring device is configured to determine a defect of the housing and disconnect the LED from power in case said defect is detected.

In the context of the present invention, the term "defect" refers to any condition which may result in the loss of the electric shock protection properties of the housing. The term "defect" may thus refer to any failure of the housing, such as breakage or crack formation. Certainly, the term "defect" may further refer to a state in which the housing or a part of the housing is removed, for example unintentionally, by a careless user.

In case a defect is detected, the isolation monitoring device disconnects said LED from power, as stated above. The term "power" in this connection may refer to any type of electrical power supply, such as a battery, a power supply unit or a mains connection.

The invention thus advantageously allows monitoring the condition of the housing and determining whether operation of the LED lamp is still safe. In case operation of the LED lamp is not safe due to a defect of the housing, the at least one LED is disabled to reduce the risk of electric shock to the user.

Certainly, the isolation monitoring device may be preferably adapted to disconnect any further uninsulated electrical part in said housing from power in the case of a defect to further reduce the risk of electric shock.

The LED lamp may certainly comprise further components, such as electric or electronic circuitry, a lamp ballast, a power supply, control electronics, e.g. for color control in the case of an RGB-lamp, a reflector or any other type of optical component, depending on the application.

In the operational state, the at least one LED may be provided with electrical power by any suitable means. Preferably, said at least one LED is connected with an electrical power supply, such as a battery, a power supply unit or a mains connection, e.g. using a suitable supply line. Certainly it is not necessary that the at least one LED is directly connected with said power supply, as it may be possible that a further electric or electronic device, such as a lamp ballast or control unit is arranged between said LED and said power supply, e.g. to control said LED or for power conditioning. Preferably and most simply, said lamp ballast comprises a suitable series resistor, so that said at least one LED may be operated at a substantially constant current, in dependence on the supply voltage, the LED forward voltage and the series resistor. Most preferably, said ballast includes stabilization circuitry, e.g. to reduce pulsation of the current or to reduce temperature dependency of the LED lamp.

The isolation monitoring device may be adapted to determine said defect depending on the type and geometry of the housing and the specific application. For example, the isolation monitoring device may comprise a suitable detector, such as an optical detector for visual inspection of said housing, e.g. a camera.

To disconnect said at least one LED from power in case of a defect, the isolation monitoring device may comprise any suitable contact breaking means. For example, the isolation monitoring device may comprise one or more switches to temporarily or permanently disconnect said at least one LED from power. The switches may e.g. be mechanically or electrically actuated in case of said defect. Certainly, any other type of mechanical or electrical component may be used to disconnect said LED from power, such as a transistor, e.g. one or more triacs, MOSFETs or fuses.

Preferably, said isolation monitoring device is connected in series between said at least one LED and said power supply, which simplifies the setup of the LED lamp.

Although it is sufficient that said LED is disconnected from power, so that the current flow through the LED is stopped to reduce the risk of electric shock to a user, e.g. using a single pole switch, it is preferred that the isolation monitoring device is configured to remove hazardous voltage from the terminals of said LED in case of said defect. The term "hazardous voltage" in this connection refers to a voltage, dangerous to the user, as defined in the applicable electrical standard, e.g. 60V. If the LED lamp is adapted to the AC/mains voltage, the isolation monitoring device is most preferably adapted to disconnect the at least one phase, e.g. provided by the supply line.

According to a further preferred embodiment, said contact breaking means are configured for all-pole disconnection of said LED from power. In the context of the present invention, "all-pole disconnection" is understood to mean that all electrical terminals of said LED are disconnected from power, i.e. are potential-free. All-pole disconnection of said LED enhances the safety of the operation of the LED lamp substantially and provides further improved electric shock protection.

Especially in cases where said LED lamp is operated by means of an alternating current, it may be difficult to determine the phase and neutral supply lines, for example in retrofit applications, so that it is advantageous to disconnect all terminals of said LED lamp from power to further enhance the safety of the LED lamp.

If the LED lamp comprises a lamp ballast, adapted to the mains voltage, said contact breaking means should be arranged on the mains side of said ballast, so that said hazardous voltage is safely removed.

If the LED lamp comprises an energy storage device (e.g. a capacitor), electrical energy hazardous to the user may be present within the LED lamp even after the LED is disconnected from power. Therefore, it is especially preferred that an energy dissipation device is arranged to remove electrical energy. The energy dissipation device may for example comprise a suitable discharge resistor, which drains the energy storage device. Alternatively or additionally, the energy dissipation device may comprise a voltage limiter.

Most preferably, the energy dissipation device is switchable. In case of a defect, the isolation monitoring device may then connect the energy dissipation device to the energy storage device, so that a safe discharge is provided.

According to a development of the invention, the monitoring device comprises contact breaking means for permanently disconnecting said LED from power in case a failure of said housing is detected.

The setup of the LED lamp according to the present embodiment further enhances the safety of the device, because even in the case of tampering or dangerous attempts to repair the LED lamp, the LED is not energized again.

The circuit breaking means according to the present embodiment may be of any suitable type to provide a permanent disconnection. Preferably, said circuit breaking means comprise one or more fuses, which safely disconnect said LED from power in case of a failure, e.g. using a switchable circuit arrangement, provided for short-circuiting said at least one fuse. Most preferably, said at least one fuse is arranged in said supply line. It is especially preferred that at least two fuses are arranged for all-pole disconnection of said LED from power.

According to a further preferred embodiment of the invention, the housing comprises a base member, adapted for removable engagement with a lamp socket to provide said LED with power.

The present embodiment advantageously allows a simple replacement of the LED lamp in case of a defect. Furthermore, the configuration allows said LED lamp to be easily used for retrofit applications, i.e. for replacing incandescent or halogen lamps. Preferably, said LED lamp is a retrofit LED lamp.

The base member may be of any suitable type, depending on the application. For example, the base member may preferably comprise a screw thread (edison screw) for corresponding edison-type screw-in lamp sockets. Alternatively or additionally, the base member may comprise a bayonet cap for corresponding bayonet mounts or e.g. a pin base.

The base member may comprise electric circuitry for connecting said at least one LED and the further components of the LED lamp to a suitable power supply connected to the lamp socket. Preferably, the base member is adapted to the mains voltage. Most preferably, said isolation monitoring device is integrated with said base member, which reduces the complexity of the LED lamp. In the case of an Edison-type base member, it is further preferred that the isolation monitoring device is configured to disconnect at least the center contact of said base member, i.e. the phase, from said LED in case of a defect.

According to a development of the invention, the LED lamp is adapted to the mains voltage. In the context of the present invention, the term "mains voltage" refers to the voltage of typical power grids, i.e. greater than 48V. Usually, said mains voltage is between 100 V and 240 V AC.

The present embodiment enables the LED lamp to be used in retrofit applications more easily, since no modification should be necessary to the lighting fixture.

Especially if the LED lamp is configured for line or mains voltage, the LED lamp may comprise additional electronic components to provide said at least one LED with a suitable operating voltage and current, depending on the type of LED used.

For example, a typical white LED may be operated at a DC voltage of 3V. Particularly in such a case, the LED lamp may be provided with a suitable ballast unit as discussed above and/or a further arrangement comprising a transformer, a rectifier/series capacitor circuit or any other suitable type of converter unit and/or a switching power supply.

Alternatively or additionally, and according to a further preferred embodiment of the invention, said at least one LED is adapted to the mains voltage.

The present embodiment advantageously further reduces the complexity of the device. The LED may be of any suitable type powered by a mains voltage supply. For example, said LED may be an ACLED, which can be directly operated at an alternating mains voltage between 100 and 240V without the need for a transformer or converter unit. Alternatively, said LED may be a high-voltage LED, adapted to the mains voltage. Certainly, a rectifier or a suitable lamp ballast may be provided in this case.

As mentioned above, the monitoring device may comprise any suitable detector for determining a defect of the housing, such as e.g. an optical detector. The monitoring device should preferably be adapted to the geometry and material of the housing to allow reliable detection of said defect.

According to a preferred embodiment, the isolation monitoring device comprises one or more detection circuits, which are at least partly integrated with said housing. The isolation monitoring device is adapted to monitor the condition of the detection circuits to determine said defect.

The present embodiment allows efficient and reliable determination of a defect of the housing by monitoring the condition of said detection circuits, which are at least partly integrated with said housing, i.e. a defect of said housing also influences at least one detectable parameter of said detection circuits, such as conductivity, capacity or inductivity.

The detection circuits may be integrated with said housing by any suitable means, e.g. by bonding or printing of said detection circuits on the surface of said housing, by application of a conductive lacquer on the housing, which then forms part of said detection circuits, or by integrally molding of said housing with the at least one detection circuit. Certainly it is sufficient that a part or section of said detection circuits is integrated with said housing.

Most simply, and especially preferred, the isolation monitoring device is configured to determine the defect and disconnect said LED from power in case at least one of said detection circuits is interrupted.

For example, the isolation monitoring device may be configured to monitor the current flow through the detection circuits to determine whether at least one circuit is interrupted. The at least one detection circuit may be provided with said current by a suitable power supply. Preferably, the detection circuit is connected to the supply line powering the LED.

If the LED lamp is adapted to the mains voltage, the at least one detection circuit preferably comprises at least one isolating device, e.g. a Y-capacitor or a suitable high-impedance resistor, so that in case of a defect, the housing is not energized with a hazardous voltage.

According to a further preferred embodiment, the monitoring device comprises a pressure sensor for determining the pressure of a medium in said housing. The monitoring device is further adapted to disconnect said LED from power in case the determined pressure does not correspond to a predetermined threshold value.

The present embodiment allows reliable detection of a failure of the housing by determining the pressure of a medium, such as cooling liquid or air, present in the housing.

The pressure sensor may be of any suitable type, e.g. a mechanical and/or electronic device, which disconnects said LED from power in case the pressure does not correspond to said threshold value, which is indicative of a defect of the housing, e.g. by actuating said contact breaking means. Although it is preferred that said pressure sensor is an active device, allowing a measurement of the actual pressure in said housing, it is sufficient if said pressure sensor allows a comparison between the pressure in said housing and said predetermined threshold value.

The term "threshold value" may in this context refer to an absolute pressure value, a pressure range and/or a pressure gradient, i.e. a maximal change in pressure over time, which forms a reference value for the determination of a defect of said housing.

As discussed above, said pressure sensor may most simply comprise a mechanical device for determining the pressure in the housing. For example, said pressure sensor may comprise a membrane, which is deflected according to the pressure in said housing and actuates said contact breaking means when the pressure in the housing changes to disconnect said at least one LED from power.

Preferably, the housing is pressure-sealed, so that it is possible to pressurize the medium in said housing. The pressure difference with respect to the ambient pressure should be chosen as small as possible, but large enough to allow reliable detection of said defect and to avoid accidental shut-off of said LED due to changes in the ambient pressure, long term leakage effects and/or temperature dependent pressure changes.

Most preferably, the pressure in the housing is below ambient pressure, which allows very reliable detection of a failure of said housing.

According to a development of the invention, the housing comprises a transparent cover member, arranged so that at least a part of the light, generated by said LED, is transmitted through said cover member. The monitoring device is adapted to detect a defect of said cover member.

The cover member allows providing a beam of light for the respective application in a save manner, while advantageously maintaining the electric shock protection properties of the housing.

The cover member may be made from any suitable material, e.g. glass or a transparent plastic material. The cover member may be formed according to the application and may comprise a lens, collimator or any type of beam-shaping element. Especially if the cover member is made from a plastic material, it may easily be possible to integrally mold the cover member with a beam-shaping element. Preferably, the cover member has a spherical shape, e.g. corresponding to the shape of a light bulb.

The monitoring device may be adapted to detect a failure of said cover by any suitable means. For example, the monitoring device may comprise a camera for visual monitoring of said cover.

Preferably, the monitoring device may comprise one or more detection circuits, which are at least partly integrated with said cover member, as discussed above. The isolation monitoring device is in this case adapted to monitor the condition of the detection circuits to determine said defect.

According to a development of the invention, the monitoring device comprises an optical detector arranged to receive light transmitted by said cover member. The monitoring device is configured to determine a defect of said cover member from said received light.

The detector may for example be arranged to receive light, generated by said LED, which is transmitted by said cover member, e.g. transmitted through, reflected or guided by said cover member. In case of a defect, the transmission properties of said cover member change, so that a defect can easily be determined.

For example, a fraction of the light generated by said LED will be reflected by said cover member due to the change in the dielectric properties at the interface, i.e. the surface of the cover member. The optical detector may thus be arranged to receive at least part of said reflected light, e.g. inside of the housing. In case of a defect, e.g. the removal of the cover member, the flux of reflected light decreases, so that a defect can be easily detected.

Alternatively or additionally, said optical detector may be arranged to receive light which is coupled into said cover member. A further fraction of the light, generated by said LED, is reflected by the second interface, i.e. the outer surface of the transparent cover member, and may then be guided in said cover member by total internal reflection. In case of a defect, as discussed above, the flux of the thus guided light decreases, so that a defect can be detected accordingly.

The monitoring device may be adapted to determine the failure of the cover member from said detected signal, e.g. by comparing a parameter of said signal, such as amplitude or phase shift, with a predefined threshold value, as discussed above.

The term "threshold value" may in this context refer to a value, a range and/or a gradient, which forms a reference value for the determination of a defect of said housing. The threshold value may be an absolute value, e.g. referring to an absolute signal amplitude, or a relative value, e.g. a maximum deviation of said received detection signal from said sent signal.

The threshold value may e.g. be set or stored during the final quality check of the LED lamp during manufacture thereof. The LED lamp could furthermore be programmed to emit a signal and to "learn" the signal properties referring to an intact housing or cover. In this case, all manufacturing tolerances (e.g. intensity of the transmitter and transmission properties of the cover) are inherently included.

According to a further preferred embodiment, the monitoring device comprises a transmitter for providing a detection signal and a detector, arranged relative to said transmitter to receive the detection signal transmitted by said cover member. The monitoring device is configured to determine the failure of said cover member from said detection signal.

The present embodiment allows a further enhanced detection of a defect of the housing, since the arrangement of a dedicated transmitter and a corresponding detector enables to further adapt the isolation monitoring device to the specific cover member used.

As discussed above, the transmitter provides a detection signal, which is transmitted by said cover member, e.g. transmitted through, reflected or guided by the cover member and is received by the detector.

The monitoring device then determines the failure of the cover member from said detection signal, e.g. by comparing a parameter of said detection signal, such as amplitude or phase shift, with a predefined threshold value, as discussed above.

For example, the monitoring device may be configured to compare the amplitude of the received detection signal with the amplitude of said sent signal and to interpret a maximum deviation as indication for a defect of the housing.

The transmitter may be configured to provide any suitable detection signal, depending on the application, the material and dimensions of the cover member. Certainly, the detector should be configured accordingly to receive said signal. The transmitter may for example be adapted to provide an electromagnetic signal, e.g. a radio frequency signal.

Preferably, the transmitter is a light source and the detector is an optical detector. The transmitter provides a beam of light, which is transmitted by the cover member and is received by said detector accordingly. The transmitter may be of any suitable type, such as an LED, preferably an infrared LED. The detector should be at least sensitive to the light, emitted by said transmitter and may comprise e.g. a photodiode or a suitable phototransistor.

Preferably, said transmitter is arranged so that a beam of light is coupled into and/or guided by the transparent cover member, which allows extensive monitoring of the cover member.

The transparent cover member forms a light guide, as discussed above, transmitting said beam of light to said detector. A failure of the cover member results in a change of the light guiding properties of said cover member, allowing a failure of said cover member to be easily determined, e.g. by comparing the amplitude of said received detection signal with an amplitude threshold.

Preferably, said monitoring device is configured to determine the signal amplitude of the received detection signal and to compare said signal with the amplitude of the sent signal.

According to a further preferred embodiment, the transmitter may be configured to excite a vibration signal in said cover member and said detector is configured to receive said vibration signal.

In the context of the present invention, the term "vibration signal" refers to any mechanical signal which may be induced in and guided by said cover member to the receiver to determine a defect, for example structure-born noise or sound.

The transmitter may thus be configured to exert a force on the cover member, which allows subjecting the cover member to the vibration signal. As discussed above, a defect of said cover member will change its transmission properties, so that said defect may be determined from the received signal.

The detector receives said vibration signal and determines a defect of the cover member, e.g. by comparing the received signal with the sent signal and/or a predetermined threshold value. Preferably, the monitoring device is configured to determine said defect from the amplitude and/or phase shift of said detection signal.

The transmitter and detector may be of any suitable type. Preferably, transmitter and/or detector comprise piezo actuators to excite and receive said vibration signal.

According to the invention, a lighting fixture comprises at least an LED lamp as described above and a lamp socket for removable engagement with said LED lamp.

BRIEF DESCRIPTION OF THE DRAWINGS

The above and other objects, features and advantages of the present invention will become apparent from the following description of preferred embodiments, in which.

DETAILED DESCRIPTION OF EMBODIMENTS

Figure 1:
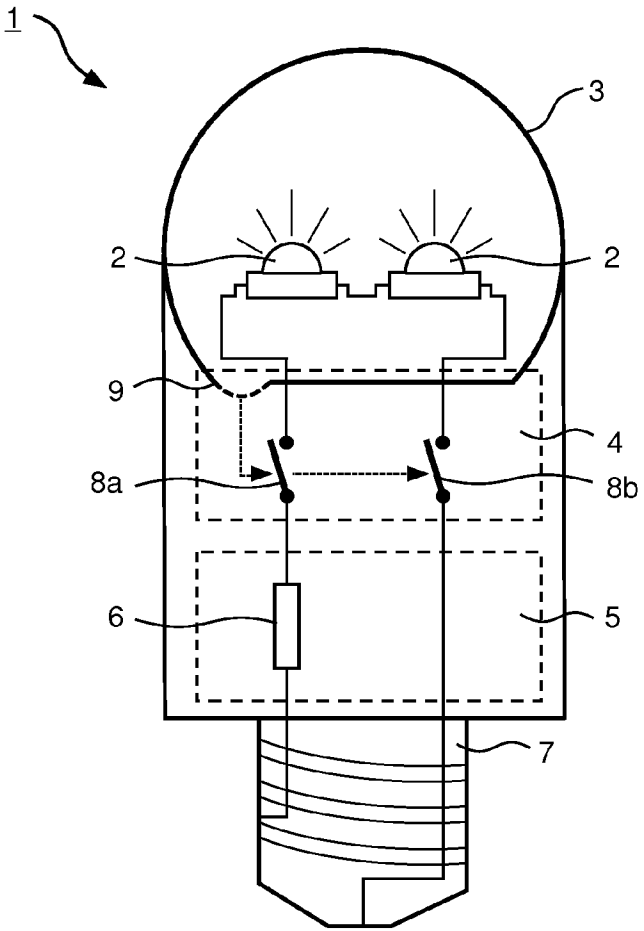
FIG. 1 shows a first embodiment of the invention in a schematic view.

FIG. 1 shows a first embodiment of an LED lamp 1 according to the invention in a schematic side view. The LED lamp 1 comprises two LEDs 2, which are of the ACLED type, adapted for direct connection to mains power, e.g. 220 V. The LEDs 2 are arranged in a lamp housing 3, i.e. a cover member, which is made from transparent plastic material and is bulb-shaped to provide undirected light and to reproduce the directional characteristic of typical incandescent lamps.

The lamp housing 3 provides electrical isolation for the LEDs 2 and its electrical connections to reduce the risk of electric shock to a user. Especially when replacing the lamp, the user will usually touch the housing 3 of the lamp 1, so that a sufficient electrical isolation is especially important here.

The housing 3 is pressure-sealed and filled with air at a pressure slightly above ambient pressure.

The LED lamp 1 further comprises an isolation monitoring device 4 and a ballast unit 5 comprising a series resistor 6 to provide the LEDs 2 with a constant current. To connect the LED lamp 1 with the mains, an Edison screw base 7 is arranged for removable engagement with a common Edison lamp socket.

As can be seen from FIG. 1, the isolation monitoring device 4 is formed integrally with said base 7 and is connected in series between the base 7, i.e. the power supply, and the LEDs 2.

The isolation monitoring device 4 comprises two switches 8*a* and 8*b* for all-pole disconnection of the LEDs 2 in case of failure of the housing 3, i.e. to disconnect all terminals of the LEDs 2 from the mains supply. The switches 8*a* and 8*b* are mechanically actuated by the force of a membrane 9, which is provided in the wall of the housing 3. The membrane 9 is made from a thin and flexible plastic material, so that the pressure difference between the housing 3 and the environment deflects the membrane 9.

In a state of normal operation, i.e. when the housing 3 is intact, the internal pressure of the housing 3 deflects the membrane 9, as shown in FIG. 1. The deflection of the membrane causes the switches 8*a* and 8*b* of the isolation monitoring device 4 to stay in the closed state, as indicated by the dotted lines in FIG. 1. The lamp 1 is thus operational and connected with the mains via the screw base 7.

Figure 2:
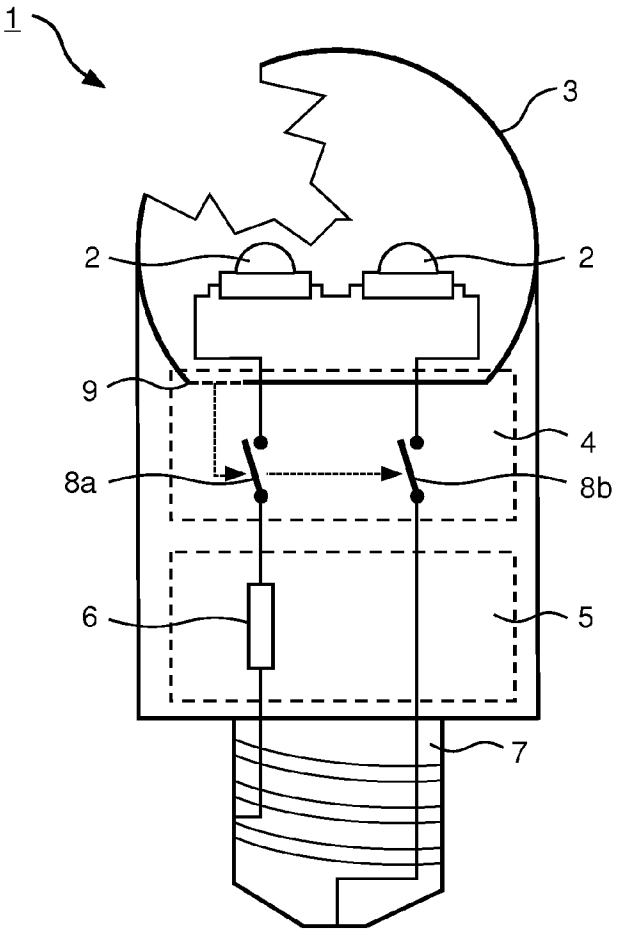
FIG. 2 shows the embodiment of FIG. 1 in a second view.

In case of a failure of the housing 3, as shown in FIG. 2, the pressure in the housing 3 decreases, causing the membrane 9 to return to a non-deflected state. Due to this, the switches 8*a* and 8*b* are opened and the LEDs 2 are all-pole disconnected from the mains, so that the LED lamp 1 may be easily replaced by a user without the risk of electric shock.

Figure 4:
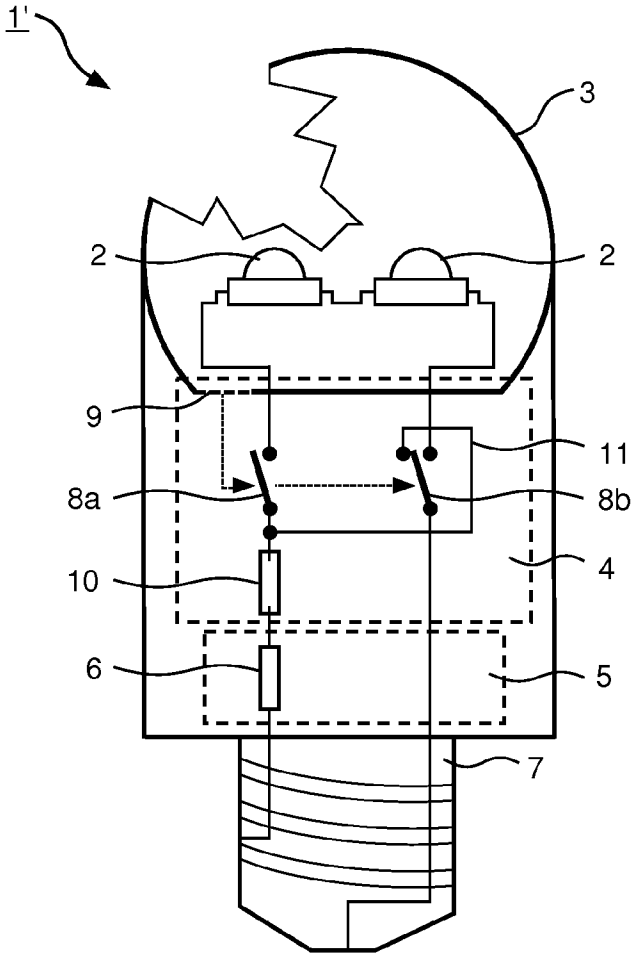
FIG. 4 shows the embodiment of FIG. 3 in a second view.
Figure 3:
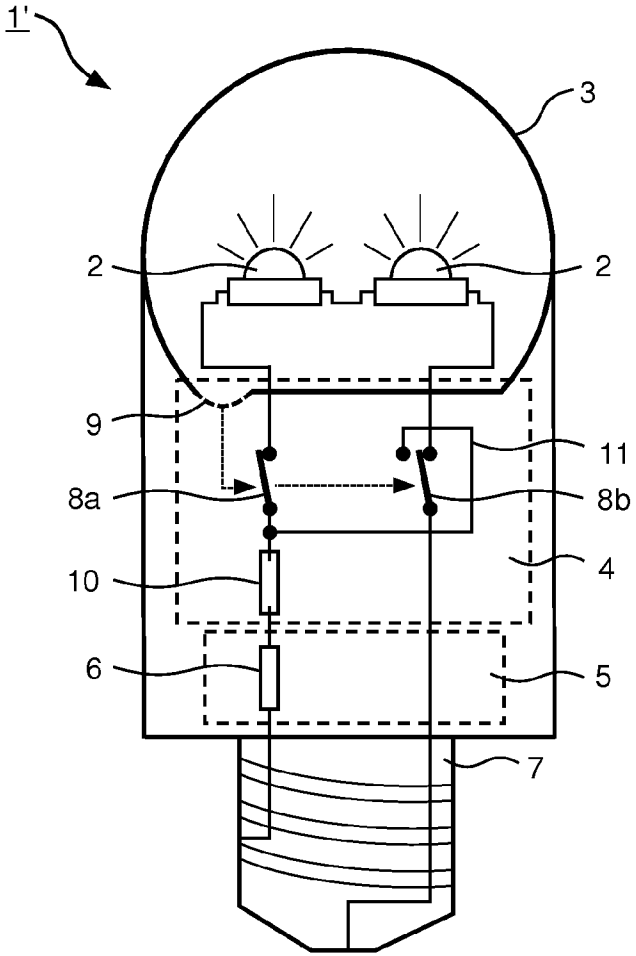
FIG. 3 shows a second embodiment of the invention in a schematic view.

FIGS. 3 and 4 show a second embodiment of an LED lamp 1'. The embodiment of FIG. 3 corresponds to the embodiment of FIG. 1, with the exception that the isolation monitoring device 4 comprises a fuse 10 to further increase the safety of the LED lamp 1', as explained in the following.

As can be seen from FIG. 3, the fuse 10 is provided in the supply line in series between the base 7 and the corresponding switch 8*a*. The switch 8*b* is provided as a two-way switch, so that the corresponding supply line can be either connected to the LEDs 2 or to a bypass line 11. In case of a defect of the housing 3, the switches 8*a* and 8*b* disconnect the LEDs 2 from the mains, as explained above. However, the switch 8*b* connects the bypass line 11 with the corresponding supply line and thus short-circuits the fuse 10. Consequently, the fuse 11 fails, thereby permanently disconnecting the LEDs 2 from power. The LEDs 2 are thus permanently set to a non-light emissive state.

According to the present embodiment of the LED lamp 1', it is not possible to bring the LED lamp 1' into an operational state after a failure of the housing 3. The failure thus results in a permanent disconnection of the LEDs 2, thereby further enhancing safety of the LED lamp 1'.

Since both the ballast unit 5 and the fuse 10 are provided on the mains side of the monitoring device 4, the series resistor 6 will limit the short circuit current when short-circuiting the fuse 10. Thus, the thermal and current-carrying requirements for the monitoring device 4 and especially the switch 8*b* are advantageously low. The fuse 10 certainly should be chosen to blow at a relatively low rating to reduce the thermal load.

Figure 6:
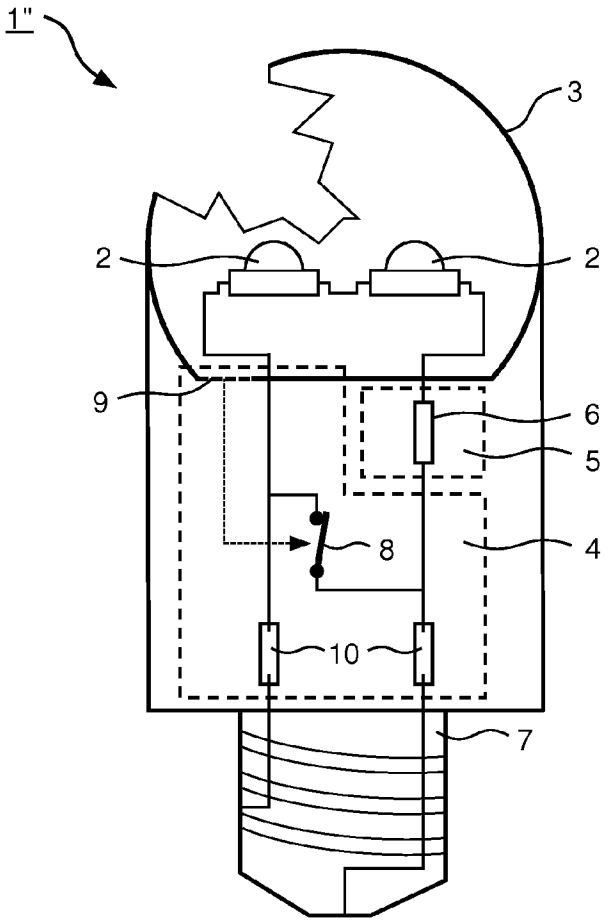
FIG. 6 shows the embodiment of FIG. 5 in a second view.
Figure 5:
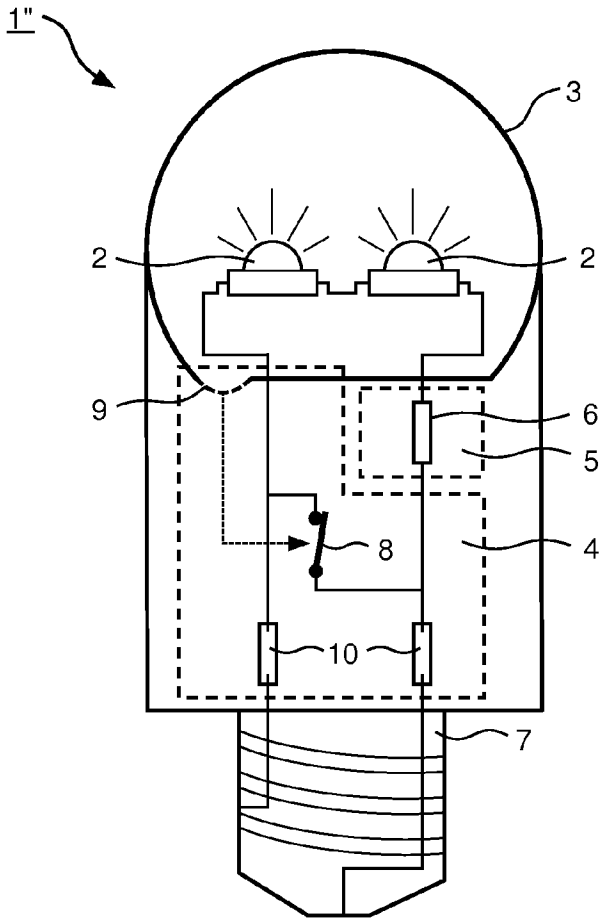
FIG. 5 shows a third embodiment of the invention in a schematic view.

A further embodiment of an LED lamp 1" is shown in FIGS. 5 and 6. The present embodiment of the LED lamp 1" corresponds to the embodiment discussed above, with this difference that the isolation monitoring device 4 comprises two fuses 10 and a single switch 8 for disconnecting the LEDs 2 in case of failure of the lamp housing 3. Furthermore, the ballast unit 5 is provided between the monitoring device 4 and the LEDs 2.

The switch 8 is operated by the mechanical force of the membrane 9, as discussed above. During normal operation of the LED lamp 1", the membrane 9 holds the switch 8 in an open position. Upon failure of the housing 3, the switch 8 is closed, as can be seen from FIG. 6, and short-circuits the fuses 10. The fuses 10 will consequently fail and thus disconnect all terminals of the LEDs 2 from power.

To achieve safe operation, the fuses 10 should be of the same type or exhibit a corresponding melting behavior, so that it is assured that both fuses 10 will fail simultaneously.

Figure 8:
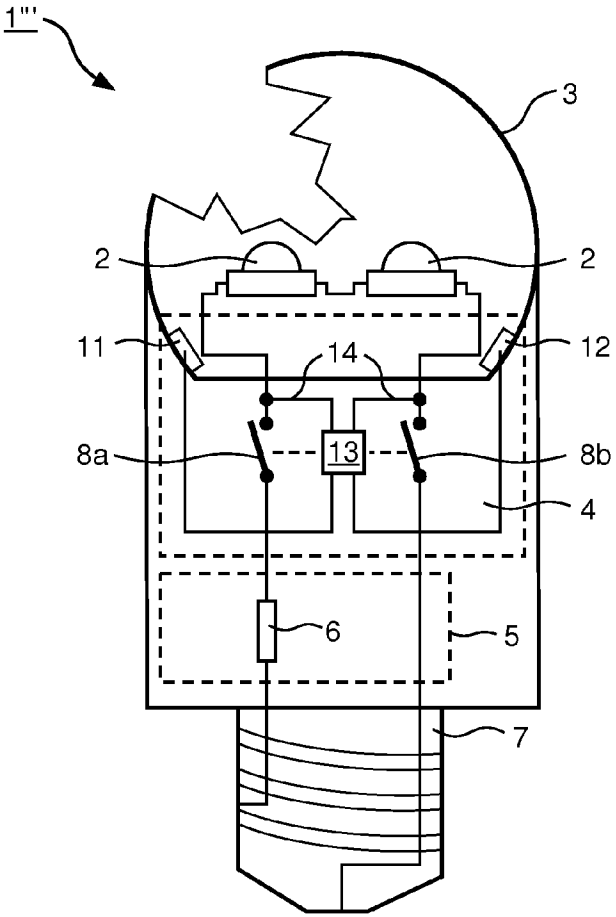
FIG. 8 shows the embodiment of FIG. 7 in a further view.
Figure 7:
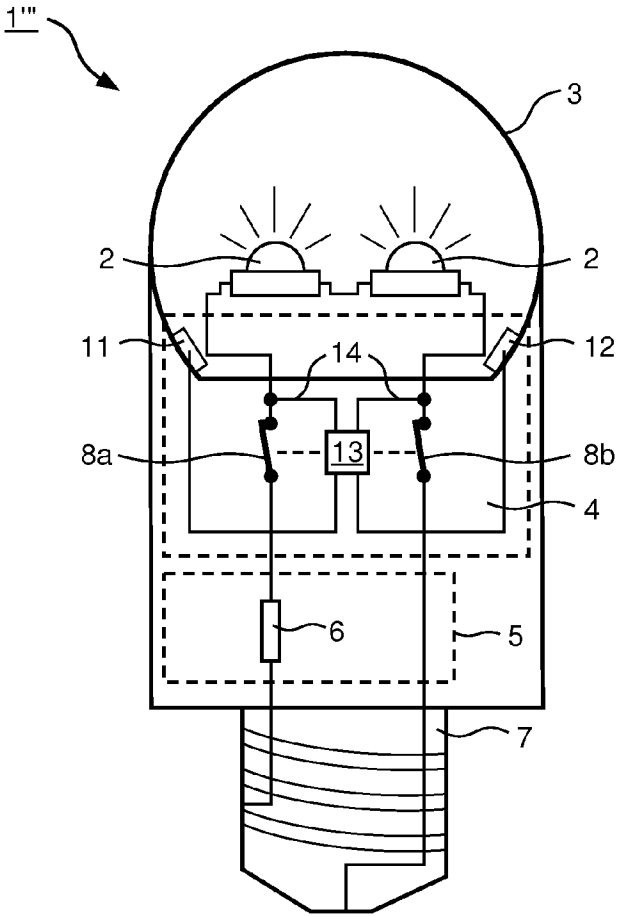
FIG. 7 shows a fourth embodiment of the invention in a schematic view.

A fourth embodiment of an LED lamp 1'" is shown in FIGS. 7 and 8. The embodiment of the LED lamp 1'" corresponds substantially to the embodiments explained above, with this difference that the isolation monitoring device 4 comprises a light source 11 and an optical detector 12 to determine a defect of the housing 3.

The light source 11 is an infrared LED and is arranged to couple emitted light into the housing 3. The emitted light is then guided by the housing 3 by total internal reflection and then received by the detector 12.

The light source 11 is driven by a controller 13 of the isolation monitoring device 4, e.g. a micro-controller, to emit a signal, which is then received by the detector 12 through the housing 3. The controller 13 then compares the amplitude of the received signal with the sent signal. The difference of the amplitudes is then compared with a maximum amplitude threshold to determine a defect of the housing 3. The amplitude threshold certainly depends on the material, geometry and dimensions of the housing 3, so that the exact value should be adapted to the corresponding application.

If the housing 3 is intact, the difference of the amplitudes of the sent and received signal is below the amplitude threshold. When the housing 3 fails, as shown in FIG. 8, the optical transmission characteristics of the housing 3 change substantially and the optical signal is attenuated. The attenuation of the signal results in a relatively high difference between the sent and received signal above the threshold. The controller 13 then actuates the switches 8*a* and 8*b* to disconnect the LEDs 2 from the mains to allow safe removal of the LED lamp 1'".

As shown, the controller 13 is powered by corresponding power lines 14, which are arranged so that in case of a defect, the controller 13, the light source 11 and the detector 12 are deactivated and removed from power to enhance the safety of the LED lamp 1'".

Figure 10:
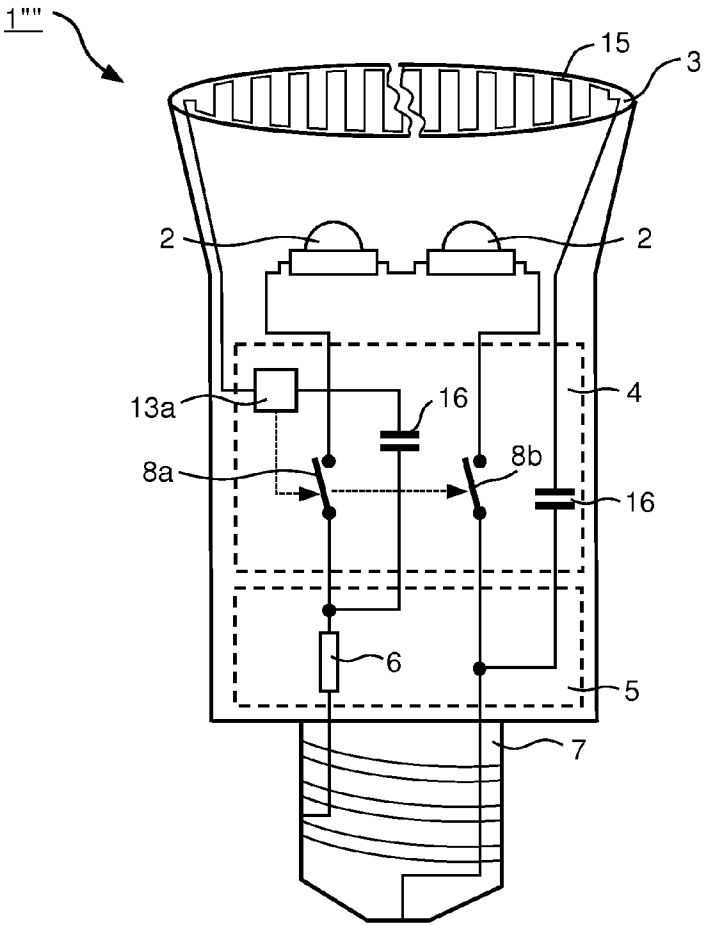
FIG. 10 shows the embodiment of FIG. 9 in a further view.
Figure 9:
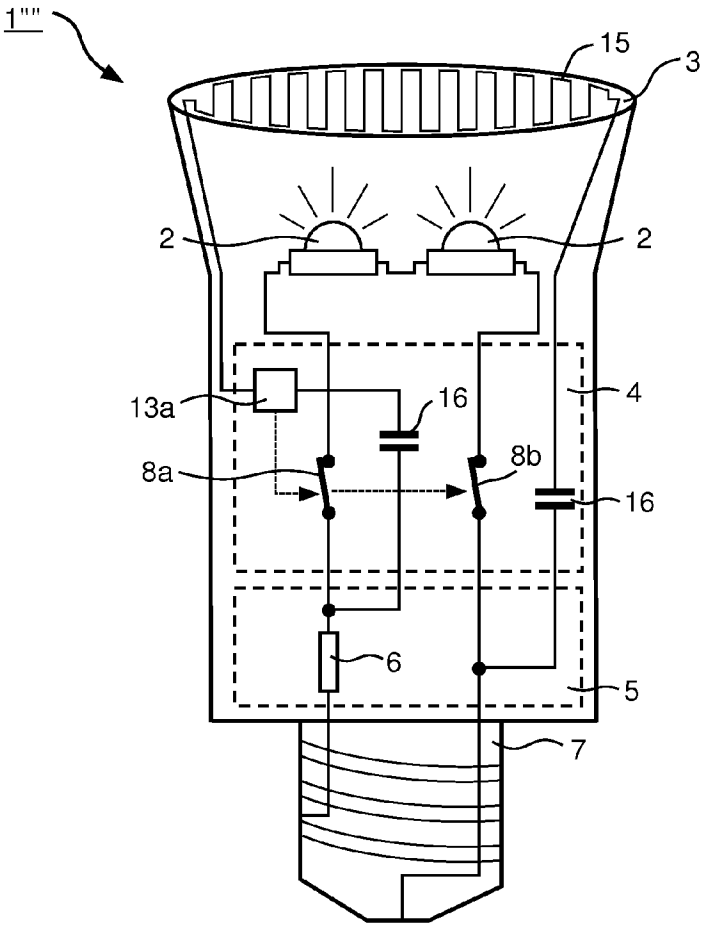
FIG. 9 shows a fifth embodiment of the invention in a schematic view.

A fifth embodiment of an LED lamp 1"" is shown in FIGS. 9 and 10. The present embodiment of the LED lamp 1"" corresponds substantially to the embodiment explained above. Here, the housing 3 shows a flat light emitting surface to provide directed light. Furthermore, instead of the arrangement of the light source 11 and the detector 12, a controller 13*a* is provided, connected with a detection circuit 15.

As shown, the detection circuit 15 meanders on the inner side of the housing 3. The detection circuit 15 is printed on the surface of the housing 3, using a conductive lacquer and is thus formed integral with the housing 3.

The detection circuit 15 is connected with the ballast unit 5, so that during normal operation a small current flows through the detection circuit 15. To provide a sufficient electrical isolation in case of a defect of the housing 3, two high-voltage Y-capacitors 16 are provided having a relatively low capacitance (a few nF). The detection circuit 15 thus can be considered as isolated from the mains, so that in case of a defect, no hazardous voltage is present on the transparent housing 3.

The controller 13*a* monitors the current flow through the detection circuit 15. In case of a defect of the housing 3, as can be seen from FIG. 10, the detection circuit 15 is interrupted. The controller 13*a* detects the interruption and then disconnects the LEDs 2 from power.

The invention has been illustrated and described in detail in the drawings and foregoing description. Such illustration and description are to be considered illustrative or exemplary and not restrictive; the invention is not limited to the disclosed embodiments. It may for example be possible to operate the invention according to an embodiment, in which:

instead of ACLEDs, high-voltage LEDs, standard DCLEDs, a laser diode or other types of LEDs are used, the isolation monitoring device 4 and/or the ballast 5 of the LED lamp 1, 1', 1", 1''', 1'''' are arranged inside of the lamp housing 3, a single LED or more than two of LEDs 2 are used, in the embodiments of FIGS. 1-6, instead of overpressure, the housing 3 is provided with a pressure below ambient pressure, instead of a ballast unit 5, either no ballast unit or a further type of ballast unit is used depending on the application and the type of LED, instead of the switches 8, electronic switches, such as MOSFETs and/or Triacs, preferably with a sufficient isolation voltage rating and leakage current rating are used, instead of the Edison type screw base 7, a further type of removable base, such as a bayonet base or a pin base for removable engagement with a lamp socket, is employed, in the embodiment of FIGS. 7-10, one of the fuse arrangements of FIGS. 3-6 is used to permanently disconnect the LEDs 2 from power in case of failure of the housing 3, in the embodiment of FIGS. 7 and 8, instead of a light source 11 and an optical detector 12, a transmitter is used, configured to excite a vibration signal in the housing 3, and a detector is employed, configured to receive said vibration signal and/or in the embodiment of FIGS. 9 and 10, instead of the capacitors 16, high-impedance resistors are used, the detection circuit 15, instead of being connected to the mains, is connected to a further power supply, safely isolated from the mains and/or instead of the controller 13*a*, the current flow through the detection circuit 15 is directly used to drive the switches 8*a* and 8*b*, for example in the case that electronic switches or relays are used.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope thereof.

The invention claimed is:

1. An LED lamp comprising at least a light emitting diode arranged in a housing, an isolation monitoring device configured to determine a defect of the housing and disconnect said at least one LED from power in case said defect is detected by the isolation monitoring device; and wherein said monitoring device comprises a pressure sensor for determining the pressure of a medium in said housing and said monitoring device is adapted to disconnect said LED from power in case the determined pressure does not correspond to a predefined threshold value.

2. The LED lamp according to claim 1, wherein said monitoring device comprises contact breaking means, configured for all-pole disconnection of said LED from power in case said defect is detected.

3. The LED lamp according to claim 1, wherein said monitoring device comprises contact breaking means, configured to permanently disconnect said LED from power in case said failure is detected.

4. The LED lamp according to claim 1, wherein said housing comprises a base member, adapted for removable engagement with a lamp socket to provide said LED with power.

5. The LED lamp according to claim 1, further adapted to the mains voltage.

6. The LED lamp according to claim 1, wherein said LED is adapted to the mains voltage.

7. An LED lamp comprising at least a light emitting diode arranged in a housing, an isolation monitoring device configured to determine a defect of the housing and disconnect said at least one LED from power in case said defect is detected by the isolation monitoring device;

wherein said housing includes a transparent cover member arranged so that at least part of the light, generated by said LED, is transmitted through said cover member, and wherein said monitoring device is adapted to detect a defect of said cover member; and wherein said monitoring device comprises a transmitter for providing a detection signal, and a detector, arranged relative to said transmitter, to receive the detection signal transmitted by said cover member, wherein said monitoring device is configured to determine a failure of said cover member from said detection signal.

8. The LED lamp according to claim 7, wherein said transmitter is a light source and said detector is an optical detector.

9. The LED lamp according to claim 7, wherein said transmitter is configured to excite a vibration signal in said cover member and said detector is configured to receive said vibration signal.

10. A Method of operating an LED lamp comprising at least one light emitting diode and a housing, comprising determining a defect of said housing by using an isolation monitoring device through a pressure sensor membrane; and disconnecting the at least one LED from power when the determining of a defect indicates a detected housing pressure does not correspond to a predetermined pressure.

* * * * *